US005150697A

United States Patent [19]

Akagi et al.

[11] Patent Number: 5,150,697

[45] Date of Patent: Sep. 29, 1992

[54] IGNITION SYSTEM

[75] Inventors: Motonobu Akagi; Nobuyuki Oota; Yasutoshi Yamada, all of Aichi, Japan

[73] Assignee: Aisin Seiki K.K., Kariya, Japan

[21] Appl. No.: 677,062

[22] Filed: Mar. 29, 1991

[30] Foreign Application Priority Data

Mar. 29, 1990 [JP] Japan ..... 2-83633

[51] Int. Cl.[5] ..... F02P 3/12

[52] U.S. Cl. ..... 123/643; 123/620

[58] Field of Search ..... 123/643, 620

[56] References Cited

U.S. PATENT DOCUMENTS 4,441,479 4/1984 Endo ..... 123/643
4,455,989 6/1984 Endo ..... 123/643
4,733,646 3/1988 Iwasaki ..... 123/643
4,738,239 4/1988 Haines ..... 123/643
4,825,844 5/1989 Fasola ..... 123/643
4,852,536 8/1989 Maier ..... 123/643
4,922,883 5/1990 Iwasaki ..... 123/620

FOREIGN PATENT DOCUMENTS 2099917 12/1982 United Kingdom ..... 123/620

*Primary Examiner*—Carl S. Miller
*Attorney, Agent, or Firm*—Sughrue, Mion, Zinn, Macpeak & Seas

[57] ABSTRACT

An ignition system for an automobile including a spark circuit, a power supply circuit for supplying power, a switching circuit for supplying power from the power supply circuit to the spark circuit, a distributing circuit for controlling the switching circuit in accordance with a ignition timing signal, and a control circuit for receiving the ignition timing signal and for disabling the distributing circuit for a predetermined period of time in response to a value of the received ignition timing signal.

11 Claims, 3 Drawing Sheets

COIL n
COIL n
COIL 1
COIL 2
COIL 3
COIL 1
COIL 2
COIL 3
+B
+Vc
IGM
SEL 1
SEL 2
SEL 3
IC
G1A
G
A
B
C
G2B
Y1
Y2
Y3
Y4
Y5
Y6
20
21
22
23
24
24a
24b
24c
25
25a
26
27
28
29
30
31
40
41
42
43
44

IGNITION SYSTEM

BACKGROUND OF THE INVENTION

The present invention relates to an ignition system for an automobile and, particularly to an ignition system for converting the direct current for igniting an engine.

An example of a known ignition system for an automobile is shown in FIG. 3 which includes a battery 1 for supplying power which is converted into a high voltage signal by a DC-DC converter 2. This converted voltage signal is supplied to an ignition condenser or capacitor 4 through a discharging circuit 3 including a thyristor 3*a*. An LC resonance circuit is formed by a condenser 2*a*, a choke coil 3*b* and the condenser 4. The LC resonance circuit discharges a charged capacitance of the condenser 2*a* to the condenser 4 which is charged with almost twice the voltage of the DC-DC converter output voltage. The charged energy of the condenser 4 corresponds to an ignition energy for one spark. An engine computer 5 supplies a pulse signal which indicates the ignition duration in accordance with a throttle, engine revolution, etc. An ignition control circuit 6 consists of a control circuit 6*a*, an oscillator 6*b* and a switching transistor 6*c*. The control circuit 6*a* supplies an ignition signal SA in accordance with the pulse signal of the engine computer 5. The oscillator 6*b* oscillates in a certain period while the ignition signal SA is applied. This oscillator 6*b* consists of a mono-stable multivibrator and serves to determine the charge and discharge time of the condenser 4 in accordance with a charge signal SC and a discharge signal SB, respectively. The switching transistor 6*c* turns ON when the discharge signal SB is applied and allows the discharged current to flow from the condenser 4 to the choke coil 7 and a transformer 8. Another LC resonance circuit is formed by the condenser 4, the choke coil 7 and the transformer 8. A discharged current increases along with the oscillation period of the LC resonance circuit and becomes a maximum voltage when the discharge of the condenser 4 is completed. The primary current of the transformer 8 is connected to ground. The second current of the transformer 8 is connected to a spark plug 10 so that the magnetic energy of the transformer at the second current converts into a spark. The known circuit includes a clamp circuit 11 for setting the voltage applied to the switching transistor 6*c* to a predetermined voltage level.

In the known ignition system, the oscillator 6*b* is a self oscillator and determines the charge and discharge time of the condenser 4. Consequently, the ignition system is not able to change the discharge durations of the spark plug 10 in order to stabilize the engine combustion.

SUMMARY OF THE INVENTION

An object of the present invention is to provide an ignition system for improving the above-mentioned drawbacks of the known system and, particularly to provide an ignition system which can change the discharge durations of the spark plugs.

The present invention provides an ignition system for an automobile comprising a spark circuit including a spark plug, a power supply circuit connected to the spark circuit, a switching circuit connected to the power supply circuit for supplying power from the power supply circuit to the spark circuit, a device for supplying an ignition timing signal, a distributing circuit for sending the ignition signal to operate the switching circuit, and a control circuit for disabling the distributing circuit for a predetermined period of time when the ignition timing signal is received.

In accordance with the invention, the control circuit disables the operation of the distributing circuit for a predetermined period of time once the ignition signal is received. After the predetermined period of time, the control circuit serves to enable the distributing circuit which operates to send the ignition signal for producing a spark.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
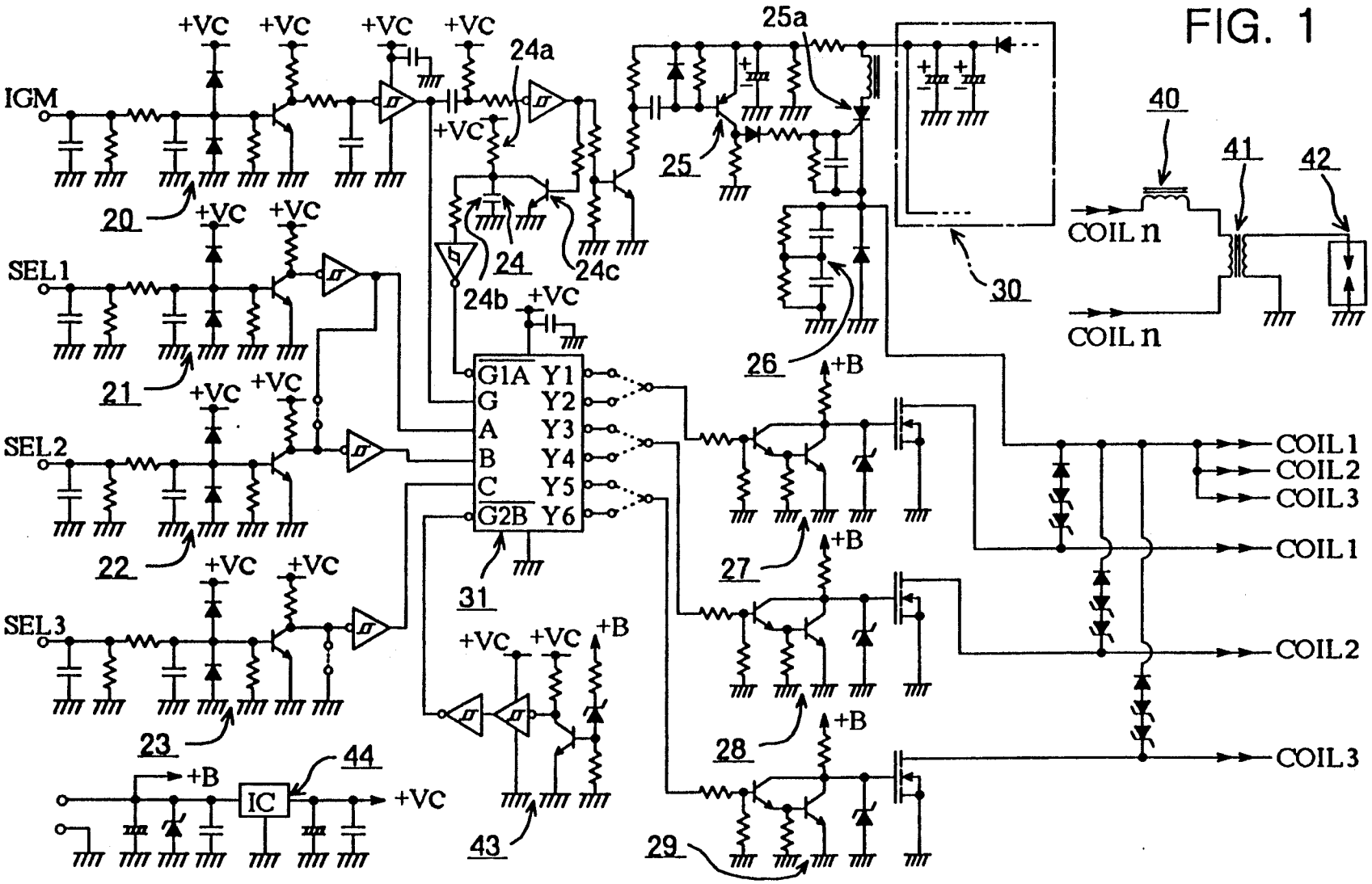
FIG. 1 is a circuit diagram of an ignition system in accordance with the present invention.

As shown in FIG. 1, the ignition system according to the invention includes input circuits 20–23. The input circuit 20 is an ignition timing signal input circuit comprising a wave shaping circuit which receives an ignition timing signal IGM. The input circuit 21 is a wave shaping circuit which receives a first distribution signal SEL 1 and outputs the shaped first distribution signal to a distributing circuit 31. The input circuits 22 and 23 are also wave shaping circuits which receive distribution signals SEL 2 and SEL 3, respectively.

The ignition timing signal input circuit 20 is connected to a terminal G of the distributing circuit 31, and outputs a logical "HIGH" signal when the ignition timing signal IGM is a logical "HIGH" signal, and outputs a logical "LOW" signal when the ignition timing signal IGM is a logical "LOW" signal. When the ignition timing signal IGM is "HIGH", the input circuit 20 allows the distributing circuit 31 to receive and supply the distributing signals SEL 1, SEL 2 and SEL 3. The output of the signal input circuit 20 is also connected to the base of the switching transistor 24*c* through a differentiation circuit and an invertor. When the ignition timing signal IGM changes from "HIGH" to "LOW", the transistor 24*c* discharges the capacitor 24*b*, and the transistor 24*c* outputs a "HIGH" signal to the terminal G1A of the distribution circuit 31 which prohibits the distribution circuit 31 from providing any output signals. This prohibiting time period is determined from the time constants of a charging resistor 24*a* and the capacitor 24*b*. A terminal G2B of the distributing circuit 31 is connected to a voltage watching circuit 43. When the voltage watching circuit 43 detects the power decrease, it sends a signal to the terminal G2B which disables the distributing circuit 31.

A driving circuit 25 for the thyristor 25*a* turns the thyristor 25*a* ON when the ignition timing signal IGM changes from "HIGH" to "LOW" so that the condenser 26 starts charging.

A switching circuit 27 turns ON in accordance with the logical "HIGH" signal of the first distributing signal SEL1 and turns OFF in accordance with the logical "LOW" signal of the first distributing signal SEL1. Switching circuits 28 and 29 operate in the same manner in accordance with the distributing signals SEL2 and SEL3, respectively.

Terminals COIL1, COIL2 and COIL3 are connected to terminals COILn. A choke coil 40 and a transformer 41 are connected to spark plug 42. The coil 40 and the transformer 41 form an LC resonance circuit which functions to transfer a discharging current from the condenser 26 to the spark plug. The DC-DC converter 30 converts a direct current voltage into a high voltage. A constant voltage circuit 44 supplies a constant voltage +Vc to the circuits of the ignition system. Circuits (not shown) including coil 40 and transformer 41 are connected to second and third spark plugs, respectively.

The operation of the inventive ignition system will now be described.

Figure 2:
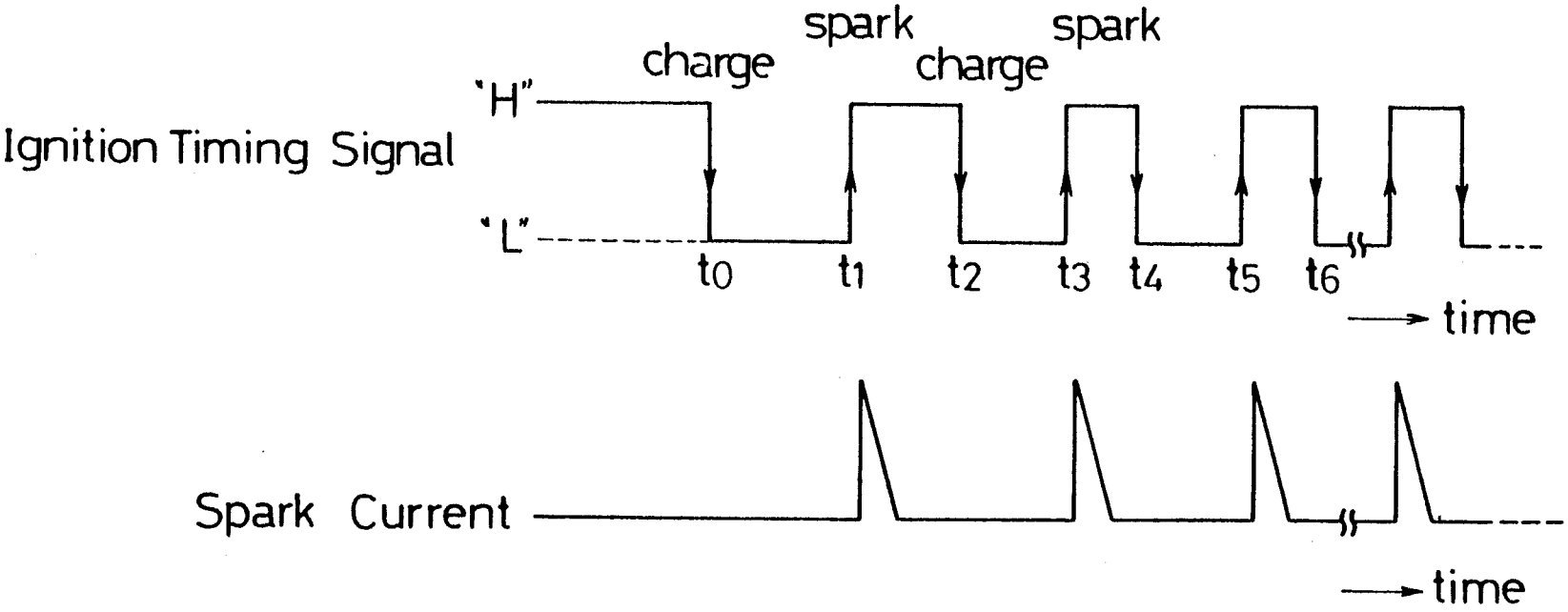
FIG. 2 is a timing chart showing the ignition timing signal and the discharge current of the ignition system in FIG. 1.
Figure 3:
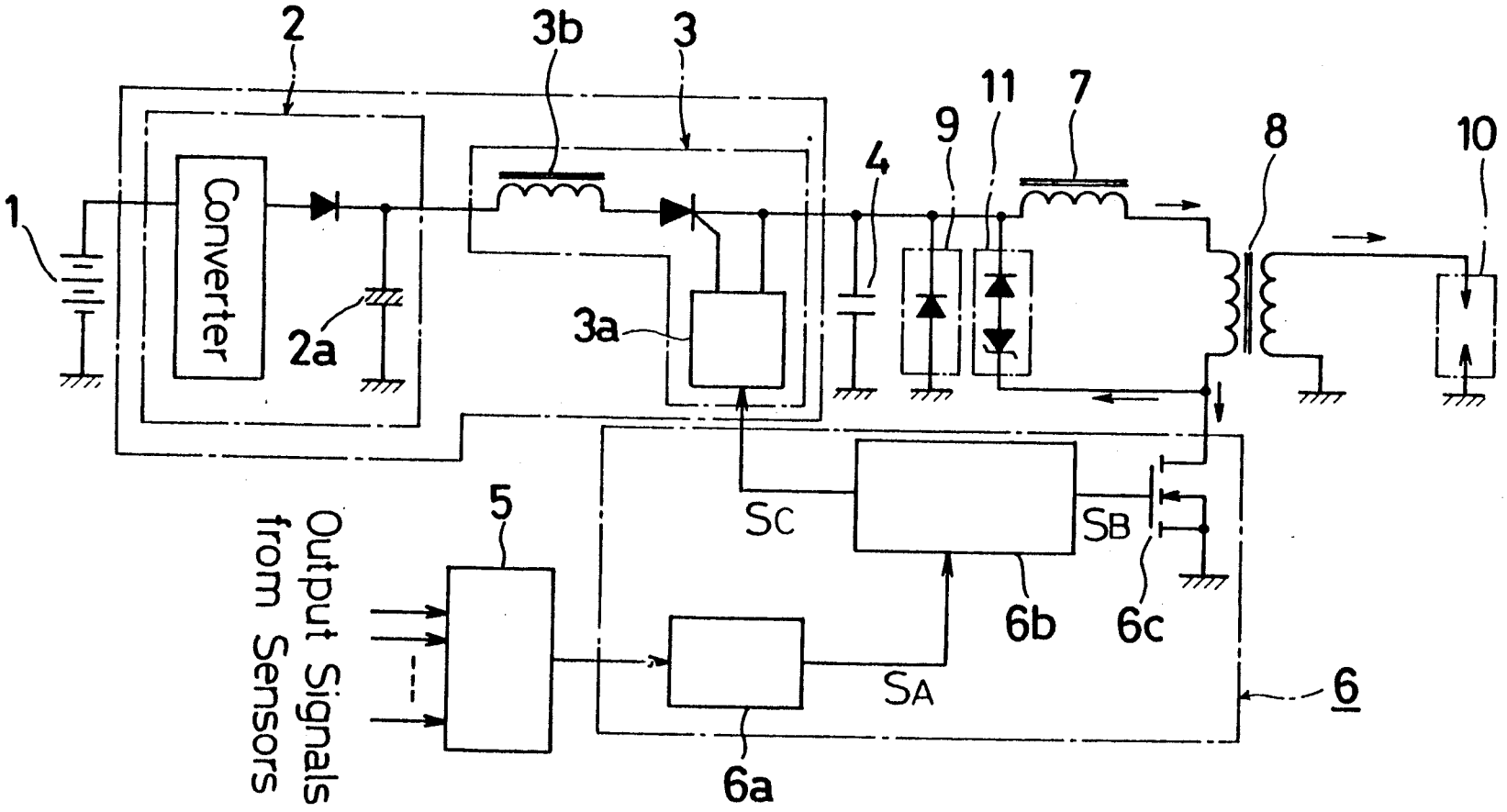
Fig. 3 (PRIOR ART)
FIG. 3 is a circuit diagram of a known ignition system.

When the first distribution signal SEL1 is applied to the distributing circuit 31, the spark plug 42 requires a signal in order to spark. The ignition timing signal IGM shown in FIG. 2 is applied to the ignition input circuit 20. When the timing signal IGM changes from "HIGH" ("H") to "LOW" ("L") at time t0, the thyristor driving circuit 25 turns ON the thyristor 25*a* to charge the condenser 26. On the other hand, when the ignition timing signal IGM is "L", the distributing circuit 31 disables the distributing circuit 31 once it receives the "L" signal at terminal G. Further, the capacitor 24*b* is discharged when the ignition timing signal IGM is "L" and starts charging with the time constant determined by the resistor 24*a* and the capacitor 24*b*. This also prevents the distributing circuit 31 from providing ignition signals.

At the time t1 in FIG. 2, the ignition timing signal IGM becomes "H" and this "H" signal is applied to the terminal G of the distributing circuit 31. In response, the distributing circuit 31 provides the first distributing signal SEL1. The switching circuit 27 turns ON in response to the "H" signal from the distributing circuit 31. The discharging current from the condenser 26 flows through the coil 40 and the transformer 41. This discharging current is increased by the LC resonance circuit formed by coil 40 and transformer 41. This discharging current becomes a maximum when the discharging of the condenser 26 is completed. Then, the magnetic energy at the second side of the transformer 41 changes into a spark at the spark plug 42. This process continues at times t3, t4, and t5 as shown in FIG. 2. The same process occurs when the distributing signals SEL2 or SEL3 is applied to the distributing circuit 31.

Thus, the distributing circuit 31 is disabled from providing output signals between the time condenser 26 starts charging (in response to the ignition timing signal IGM) and the time when the charge of the condenser 26 charges to a predetermined level. During the time that the condenser 26 is being charged, the charged current of the condenser 26 is not discharged. Further, once the condenser 26 is charged, the spark plug 42 can be sparked by applying the power from the power circuit through the spark circuit including coil 40, transformer 41 and spark plug 42. Consequently, when the condenser 26 is not charged, the spark plug can be sparked independently. Thus, the duration of the spark can be controlled.

While the invention has been particularly shown and described with reference to a preferred embodiment thereof, it will be understood by those in the art that the foregoing and other changes in form and details may be made therein without departing from the spirit and scope of the invention.

What is claimed is:

1. An ignition system for an automobile comprising:

a spark circuit;

a power supply circuit including a capacitor for supplying power;

a switching circuit operable for supplying power from said power supply circuit to said spark circuit;

a distributing circuit for controlling said switching circuit in accordance with an ignition timing signal; and a control circuit, coupled to receive the ignition timing signal, said control circuit operable for providing a disabling control signal which disables said distributing circuit for a predetermined period of time in accordance with a first value of said ignition timing signal so that said switching circuit does not supply power from said power supply circuit to said spark circuit during the predetermined period of time, said control circuit also being coupled to said power supply circuit for charging said capacitor during the predetermined period of time when said distributing circuit is disabled.

2. The ignition system as defined in claim 1, further comprising an input circuit for receiving and shaping the ignition timing signal, and wherein said control, circuit receives said shaped ignition timing signal.

3. The ignition system as defined in claim 1, further comprising an input circuit for receiving a distribution signal, and wherein said distributing circuit controls said switching circuit in accordance with the ignition timing signal and the distribution signal.

4. The ignition system as defined in claim 3, wherein said switching circuit is controlled by said distributing circuit to supply power to said spark circuit in response to said distributing circuit receiving a logical high value of the distribution signal and said control circuit receiving a logical high value of the ignition timing signal.

5. The ignition system as defined in claim 1, wherein said spark circuit comprises a coil, a transformer and a spark plug.

6. The ignition system as defined in claim 1, wherein said control circuit comprises a first circuit coupled to receive the ignition timing signal and coupled to supply the received ignition timing signal to said distributing circuit, and a second circuit connected to said distributing circuit.

7. The ignition system as defined in claim 6, wherein said first circuit comprises a resistor and a capacitor, and wherein the predetermined period of time corresponds to a time constant determined by said resistor and said capacitor.

8. The ignition system as defined in claim 6, wherein said second circuit comprises a voltage detecting circuit for detecting a voltage change of the ignition timing signal.

9. The ignition system as defined in claim 8, wherein said control circuit disables said distributing circuit when said second circuit detects that the ignition timing signal changes from a logical high to a logical low.

10. The ignition system as defined in claim 1, wherein the disabling control signal as a second value which is different from the first value of said ignition timing signal.

11. The ignition system as defined in claim 10, wherein the first value of said ignition timing signal is a logical low value, and the second value of the disabling control signal is a logical high value.

* * * * *